United States Patent [19]

Mugnai

[11] Patent Number: 4,541,224

[45] Date of Patent: Sep. 17, 1985

[54] PACKING PROCESS

[75] Inventor: Giorgio Mugnai, Milan, Italy

[73] Assignee: W. R. Grace & Co., Duncan, S.C.

[21] Appl. No.: 634,016

[22] Filed: Jul. 23, 1984

Related U.S. Application Data

[63] Continuation of Ser. No. 274,321, Jun. 16, 1981, Pat. No. 4,471,599.

[30] Foreign Application Priority Data

Jun. 25, 1980 [GB] United Kingdom ..... 8020749
Jul. 17, 1980 [GB] United Kingdom ..... 8023465

[51] Int. Cl.[4] ..... B65B 31/02
[52] U.S. Cl. ..... 531/434; 53/512
[58] Field of Search ..... 53/432, 433, 434, 510, 53/511, 512

[56] References Cited

U.S. PATENT DOCUMENTS

| | | | |
|---|---|---|---|
| 3,688,463 | 9/1972 | Titchenal | 53/434 |
| 3,693,314 | 9/1972 | Reid et al. | 53/434 X |
| 3,851,437 | 12/1974 | Waldrop et al. | 53/434 |
| 3,956,867 | 5/1976 | Utz et al. | 53/432 |
| 3,958,391 | 5/1976 | Kujubu | 53/434 |
| 4,112,124 | 9/1978 | Jarvis | 53/434 X |
| 4,164,111 | 8/1979 | DiBernardo | 53/434 |
| 4,223,513 | 9/1980 | Mahaffy et al. | 53/432 |
| 4,457,122 | 7/1984 | Atkins et al. | 53/434 |

FOREIGN PATENT DOCUMENTS

| | | | |
|---|---|---|---|
| 1561837 | 3/1980 | United Kingdom | 53/434 |
| 2058707 | 4/1981 | United Kingdom | 53/434 |

*Primary Examiner*—James F. Coan
*Attorney, Agent, or Firm*—John J. Toney; William D. Lee, Jr.; Mark B. Quatt

[57] ABSTRACT

A vacuumizing and sealing operation on a package comprises initially reducing the external pressure on the package, before sealing of the package, to a value at which the flexible film covering of the package is capable of ballooning, and ensuring heating of the flexible film of the package, preferably while an intermediate pressure is maintained (at which intermediate pressure ballooning could just be sustained without excessive evacuation to reduce the thermal capacity of the circulating air). Finally the pressure inside and outside is reduced still further before re-pressurizing.

1 Claim, 9 Drawing Figures

PACKING PROCESS

This is a continuation application of application Ser. No. 274,321, filed on June 16, 1981, now U.S. Pat. No. 4,471,599.

DESCRIPTION

The present invention relates to a process and apparatus for forming packages.

It is known, in the field of packaging articles in flexible plastics film to evacuate the interior of the package both to improve the shelf life of the packaged product and to give the package a good appearance. It is also known to improve the appearance of the sealed package by using a heat-shrinkable (i.e. oriented) film as envelope for the package and subjecting the evacuated, sealed package to a shrinking operation in which the plastics film is heat-shrunk to bring it more intimately in contact with the article therein.

It is an object of the present invention to provide a packaging process and apparatus enabling the removal of entrapped gas in the package to be facilitated.

The term "shrinking" as used herein is intended to denote the contraction of the volume of the bag after ballooning whether due to the heat-shrinking properties of the film or due to heat-softening properties of the film.

Accordingly, one aspect of the present invention provides a process for forming a vacuum sealed package comprising a flexible film covering at least one product article, such process comprising: subjecting the unsealed package to reducing pressure to attain an intermediate pressure at which ballooning of said flexible film away from the surface of the said at least one product article occurs; reducing the rate of pressure reduction, or completely suspending the pressure reduction, around the package when the film is in the ballooned condition and meanwhile heating the said ballooned flexible film; allowing the flexible film to collapse onto the surface of said at least one product article; and sealing the package before finally increasing the pressure around the package.

The gas around the package will normally be atmospheric air, but any other suitable gas may be used as desired.

A second aspect of the present invention provides apparatus for forming a package, comprising a vacuum chamber openable to allow introduction of a package thereto and to allow delivery of a package therefrom; means for evacuating the chamber; means for holding the package in the closed chamber in a condition such that the evacuation of the chamber evacuates the interior of the package at a rate slower than the rate of evacuation of the chamber; means for slowing down or interrupting the evacuation of the chamber and for applying heat to the surface of the package when the pressure in the chamber has already been reduced to an intermediate pressure lower than the starting pressure; and means for subsequently sealing the package.

The invention also provides a package formed by the method of the present invention, or by using the apparatus of the present invention.

In order that the present invention may more readily be understood the following description is given, merely by way of example, with reference to the accompanying drawings in which.

Figure 1:
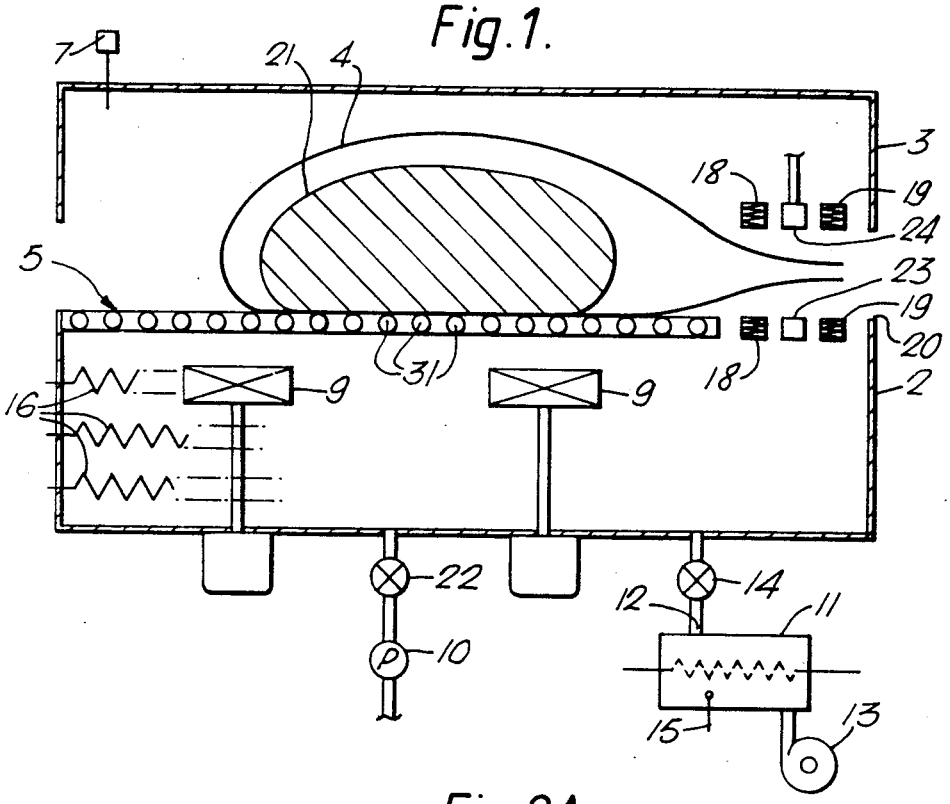
FIG. 1 is a schematic illustration of a first embodiment of apparatus for forming a shrunk, vacuum sealed package comprising a bag of heat-shrinkable film surrounding a product article.

The packaging apparatus 1 illustrated in FIG. 1 comprises a vacuum chamber consisting of a lower chamber part 2 and an upper chamber part or cover 3.

In this case, the package introduced into the chamber 1 is a loaded but unsealed bag 4. Raising of the chamber cover 3 allows the bag 4 to be placed on a support grid 5 where the package is positioned clear of the side walls of the chamber 1 and the shrinking operation can then be carried out.

The apparatus illustrated in FIG. 1 further includes a temperature sensor 6 which provides an indication of the air temperature inside the chamber, as of course this will be an important factor in the shrinking of the package. The temperature sensor may form part of a control circuit for controlling the temperature of the air in the chamber 1.

The chamber also includes a pressure sensor 7 to determine the residual gas pressure in the chamber as this pressure is important in controlling the evacuating cycle.

The chamber 1 further includes heating means, in the form of a plurality of electrical resistance heaters 16 on the walls of the lower part 2 of the chamber to heat the interior of the chamber 1 in order to heat soften and/or to heat-shrink the bag 4 to provide a pleasing appearance and effectively cavity-free contact between the bag 4 and the enclosed product article 21 in the finished package.

In this embodiment the chamber 1 further includes air circulation means, in this case two fans 9 in the lower chamber part 2, to circulate the residual gas in the chamber 1 over the exterior of the bag 4 in order to provide the necessary heat transfer to the bag material for shrinking and/or heat softening it.

Under the bottom part of the chamber is a vacuum pump 10 which is required in order to reduce the pressure of the gas remaining in the vacuum chamber 1 for the purposes to be described below.

Gas, in this case air, entering the vacuum chamber 1 before or during the early part of the evacuation step is optionally pre-heated by means of an electric resistance heater 11 in the path of the air blown into the chamber 1 along an inlet line 12 from a fan 13. This inlet line 12 enters the chamber by way of a valve 14. The temperature of the pre-heated air in the electric resistance heater 11 is sensed by a temperature sensor 15.

The various electrical resistance heaters 16 on the side and end walls of the lower chamber part 2, comprising the heating means in the chamber, are located so that air flow passing over the package in the chamber is also heated by the heaters 16. A thermocouple 17 monitors the temperature of the chamber heating means.

Although not shown in FIG. 1, loaded bags can be conveyed in a continuous succession to the vacuum chamber 1 by way of an in-feed conveyor, and can equally be discharged from the vacuum chamber 1 by way of a delivery conveyor.

The chamber of FIG. 1 is designed to ensure that, when the fans 9 are in operation, the air flow will be in a circulating path which takes the air directly over the various heaters 16 in order to maintain its temperature at the value required for shrinking and/or heat softening.

The operation of the apparatus shown in FIG. 1, when using bags 4 formed of a heat-shrinkable, i.e. orientated, film material is as follows:

A loaded but unsealed bag 4 of heat-shrinkable packaging film is placed in the vacuum chamber 1, and the chamber cover 3 is driven downwardly to close the chamber and to allow sealing of the chamber at its rim 20.

One form of a heat shrinkable film used for the bag 4 may be a three-ply laminate of ethylene vinyl acetate, polyvinylidene chloride and irradiated ethylene vinyl acetate, as disclosed in U.S. Pat. No. 3,741,253 and as sold by W. R. Grace & Co. under the Trade Mark "Barrier Bag".

Figure 2A:
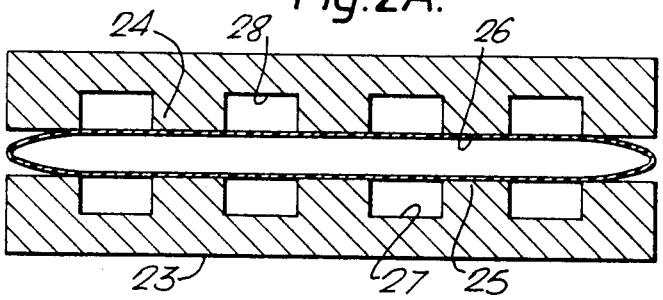
FIGS. 2A and 2B are a detail of the bag holding members of FIG. 1.
Figure 2B:
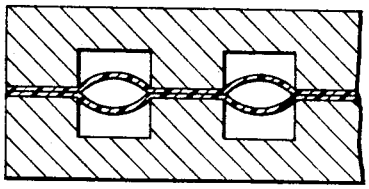

When the chamber is closed, the neck of the bag is gripped at various spaced zones by engagement with two sets of undulating clamping bars 23 and 24 (FIG. 2A) which each have engaging peaks 25, 26 to clamp the bag neck and spaced apart troughs 27, 28 to leave constricted air extraction passageways in the bag neck. FIG. 2B shows the clamping bars 23, 24 in their closed configuration.

The constriction of the bag mouth when engaged by these undulating clamping bars ensures that, as the evacuation of the interior of the chamber proceeds, gas (usually air) will be withdrawn from the interior of the bag 4 but at a rate lower than the rate of evacuation of the chamber, and consequently the bag material will balloon away from the surface of the product 21 therein. This ballooning, which is important to the present invention, can be produced in any suitable alternative manner, for example by clamping the bag neck in the early stages of evacuation to prevent evacuation of the bag interior until the bag has ballooned and been heat softened, after which the clamping action is released to allow the pressure within the bag to drop and thereby to allow the bag material to collapse back onto the product 21.

When, in the preferred embodiment of process, the chamber is effectively sealed, by closure of the cover 3 onto the lower part 2 of the chamber, and the bag 4 has its mouth constricted by the undulating clamping bars 23, 24, the vacuum pump 10 is energised to begin extraction of air from the interior of the vacuum chamber 1 and hence from within the bag 4, and the motors of fans 9 are energised to initiate the circulation of air in the chamber 1. Because of the constriction of the air extraction passageways left in the bag mouth by the troughs 27, 28 of the undulating clamping bars, the pressure inside the bag reduces more slowly than the chamber pressure outside the bag and the bag 4 balloons away from the product 21.

Once the quantity of residual air in the chamber 1 has been reduced to an intermediate value, which corresponds to ballooning of the bag 4 away from the product, the rate of evacuation of the interior of the chamber 1 is interrupted. The intermediate pressure value may, for example, be of the order of 76% residual air mass.

It is within the scope of the present invention to reduce the rate of pressure evacuation either by adopting a slower rate of evacuation while the bag material is ballooned and being heated, or alternatively, and in many cases preferably, to interrupt the evacuation by temporarily stopping the removal of air from the chamber altogether. This temporary suspension may be achieved either by stopping the vacuum pump 10 and closing a valve 22, or by closing the valve 22 communicating the vacuum pump 10 with the chamber 1 and allowing the pump 10 to continue to operate and to lower the pressure within a non-illustrated vacuum reservoir which will later be communicated with the interior of the chamber 1 when further evacuation of the chamber is subsequently required and the valve 22 is re-opened.

Although in the apparatus illustrated in FIGS. 1 to 4, the intermediate pressure value chosen is sensed by the pressure sensor 7 in the chamber, the important factor is that the evacuation of the chamber should either stop or slow down when the bag 4 has ballooned away from the surface of the product 21. Since the ballooning action will depend upon factors common to a particular batch of products 21 (for example the surface temperature, the amount of air contained within the product, and the surface nature, e.g. tackiness-of the product) it may be convenient to determine when ballooning is likely to occur and then to time the process such that the evacuation is slowed down or stopped at the same time for all the products of a batch. Alternatively, some form of feeler mechanism, to detect the ballooning physically, may be used. Any other control means may be employed, as desired.

At this stage the flow, generated by the fans 9 of the residual hot air within the chamber 1 over the bag 4 causes the ballooned part of the heat shrinkable plastic bag to shrink back on to the surface of the article 21 packaged within the bag.

Because during the heat-shrinking step, the bag is clamped at spaced regions defined by the various peaks 26, 27 of the clamping bars 23, 24, (as shown in FIG. 2B) the bag neck will remain between upper and lower heat-sealing bars 18 and will allow further escape of air from within the bag while the remainder of the bag will shrink back onto the surface of the product article 21 so as to provide a substantially wrinkle-free surface covering to the product article 21 and nevertheless leave the bag neck capable of sealing when the welding bars 18 close together to contact one another.

As shown in FIG. 1, the lower and upper undulating clamping bars 23 and 24 are carried by the lower chamber portion 2 and the chamber cover portion 3, respectively, so that they automatically close together to contact one another when the chamber is closed. All that the operator needs to do in order to arrange for the extraction of air from the interior of the package to lag behind the evacuation of the chamber interior to an extent necessary for ballooning of the bag is to ensure that the neck of the bag 4 is placed on the lower undulating clamping member 23 before the chamber closes.

If desired, where the loaded bags are introduced by a conveyor into the chamber 1 the conveyor may be one which ensures that, when the bag 4 is stopped, the bag neck is correctly positioned for constricted clamping without the need for careful positioning by an operator.

As will be readily understood, some means (not shown) will be provided for bringing one or both of the upper and lower welding bars 18 towards the other so as to ensure welding contact for bag sealing.

Figure 4:
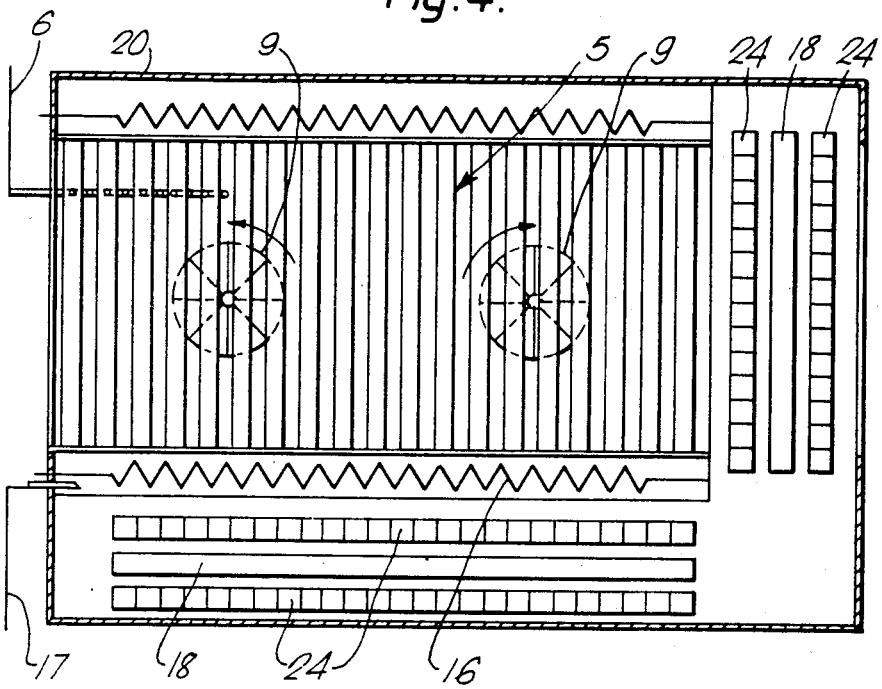
FIG. 4 is a plan view of the chamber lower part.

If desired, some other bag-holding and -closing mechanism may be provided with the apparatus of FIGS. 1 and 4. For example, the bag neck may be gathered in the chamber when the chamber is closed, to an extent consistent with the desire for ballooning of the bag away from the product as the chamber is evacuated, and a clip may then be attached to the neck of the bag after the evacuation and shrinking operations have been completed. Such in-chamber clipping means is for example disclosed in our British Patent Specification No. 1,353,157.

The product is supported on rollers 31 (FIGS. 3A and 3B) which define the air-pervious grid 5 to support the article but nevertheless allow the hot shrinking air circulation to pass right around the surface of the article.

The preferred embodiment of process described above is one in which the bag material is of a heat-shrinkable type, namely a plastics material which has been oriented, preferably bi-axially oriented, by stretching so that the application of heat will provoke a shrinking action of the bag material down from its stretched condition.

In any conventional post-sealing shrinking process, the degree of recovery of the available shrink in the film (i.e. the extent to which the film is able to return to its original configuration before the orienting stretching) is limited by the drop in temperature of the film as it contacts the product. By ensuring that, in the preferred embodiment of the present invention using a heat-shrinkable material the heating step takes place while the film is in a ballooned condition and before the packaging material is sealed around the article, it is possible to recover much more of the available shrink in the film.

The process in accordance with the present invention can, however, be employed with non-shrinkable materials. For example, the so-called self-welding bag material, for example a laminate of nylon and an ethylene-vinyl acetate copolymer can be used for the packaging film. At a temperature rather lower than that which would be expected for heat-shrinking of an oriented film, such a self-welding film softens to an extent such that as it collapses back onto the product due to pressure equalisation inside and outside the film envelope or pouch (e.g. the bag 4) the film will weld to itself and provide a substantially wrinkle-free package. Although the appearance of the package may be more pleasing when using a heat-shrinkable film, an acceptable result can be obtained with this self-welding film.

The process will operate such that initially the evacuation of the chamber and the slower extraction of air from the bag will proceed causing the bag material to balloon away from the surface of the product article 21 in the bag. Then, when ballooning is at the desired extent, for example sensed by a mechanical feeler mechanism as described above, or related to the elapsed time of evacuation or to the pressure value in the chamber, the evacuation of the chamber is considerably slowed down, or preferably completely arrested, and heat is applied to the bag in order to heat-soften the bag.

As the pressures within and outside the package equalise by escape of gas through the constricted neck of the bag held between the undulating clamping bars 23 and 24, the bag material can collapse back onto the surface of the product article and, because it is not in contact with the article during this heating step, heat will not be lost to the product article until the film contacts the article by which time the film will self-weld and will provide a neat appearance to the finished package.

Figure 3A:
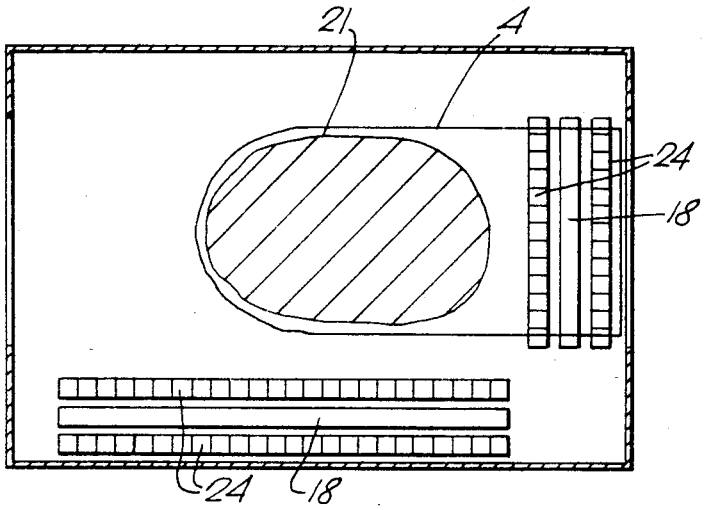
FIGS. 3A and 3B are plan views showing two alternative arrangements for bags in the chamber.
Figure 3B:
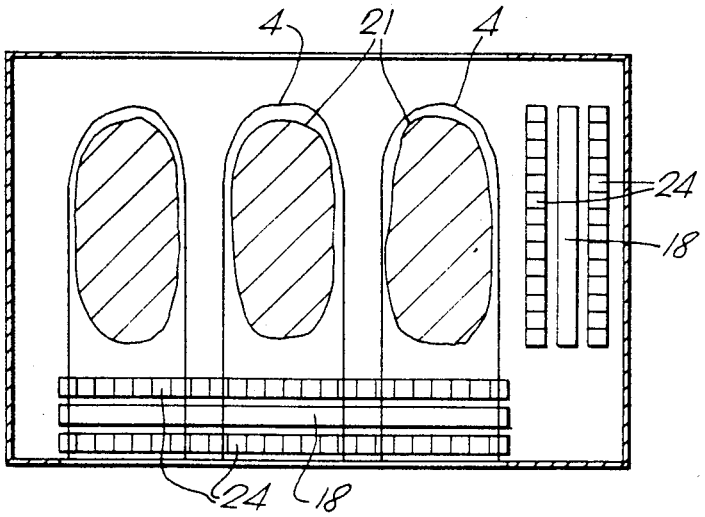

FIGS. 3A and 3B illustrate a preferred feature of the apparatus in that the undulating clamping bars, of which only the upper bar 24 is shown in these Figures, are of L-shaped configuration and so also are the welding bars 18. This ensures that several short bags can be placed side-by-side along the longer side of the L-shaped array. as shown in FIG. 3B. Alternatively, as shown in FIG. 3A, a single elongate bag can be placed in the chamber so that the bag neck is clamped at the shorter limb of the L defined by the clamping and welding bars.

The ballooning action before the main heating step ensures that the plastics material of the bag is clear of the relatively cool product article 21 in the bag and is therefore much more readily able to undergo the shrinking and/or softening because the heat transferred to the bag material from the hot air flow will not be transferred immediately to the article 21 by conduction.

The suspension of further evacuation during shrinking lasts for a brief period, for example from 2 to 8, seconds preferably six seconds, and is then resumed once the ballooned area has collapsed back into contact with the surface of the article 21 by the shrinking action of the film and/or the equalisation of pressures within and around the bag.

Further evacuation of the chamber then proceeds by continued operation of the vacuum pump 10 until the residual pressure in the vacuum chamber 1 has dropped to a finishing value of, for example, 5% residual air mass.

In the embodiment of the process where the gas in the chamber undergoes fan-assisted circulation, during this continued evacuation of the chamber the fans 9 may if desired be in constant operation so that as the density of the air remaining in the chamber 1 gradually reduces that air is still able to carry out some further shrinking of the bag material onto the external contour of the article 21.

During evacuation, the fans 9 may if desired not be put into operation until the attainment of the intermediate residual pressure in the chamber, in order to allow the bag material to balloon as rapidly as possible without the shrinking effect of the air flow. Adequate ballooning will then have occurred before shrinking heat starts to be applied.

Upon termination of the vacuum phase, the bag neck is sealed, in this case by the closing together and energising of the welding bars 18.

The valve 14 is then opened to allow the chamber 1 to be repressurised. This may for example be achieved using pre-heated air from the heater 11 by way of the valve 14. The chamber cover 1 is then raised in order to allow the resulting shrunk and sealed package to be removed from the vacuum chamber 1.

The heaters 16 within the chamber serve to keep the temperature of the air around the package at a value sufficient for the necessary exchange of heat to the ballooned bag material to achieve shrinking of the bag. However, where fan-assisted circulation of air in the chamber is used, the heaters 16 need not be in continuous operation provided that, by the time the bag 4 has ballooned away from the product article 21, the temperature of the air in the chamber is at a temperature adequate for shrinking the package.

Temperatures of 90° C. to 140° C. at ballooning may be required to achieve shrinking in the case of a biaxially oriented shrinkable film. The precise value of the temperature will depend upon factors such as the nature of the film or the degree of orientation. In the case of self-welding film the self-welding temperature of the film material will be an important factor.

A fully automatic version of the apparatus of FIGS. 1 to 4 can be envisaged, in which all the various process parameters are controlled and the apparatus is timed to operate automatically from introduction of a loaded bag into the chamber to delivery of the sealed package automatically from the chamber.

The precise value of the first intermediate pressure is variable within certain limits.

Figure 5:
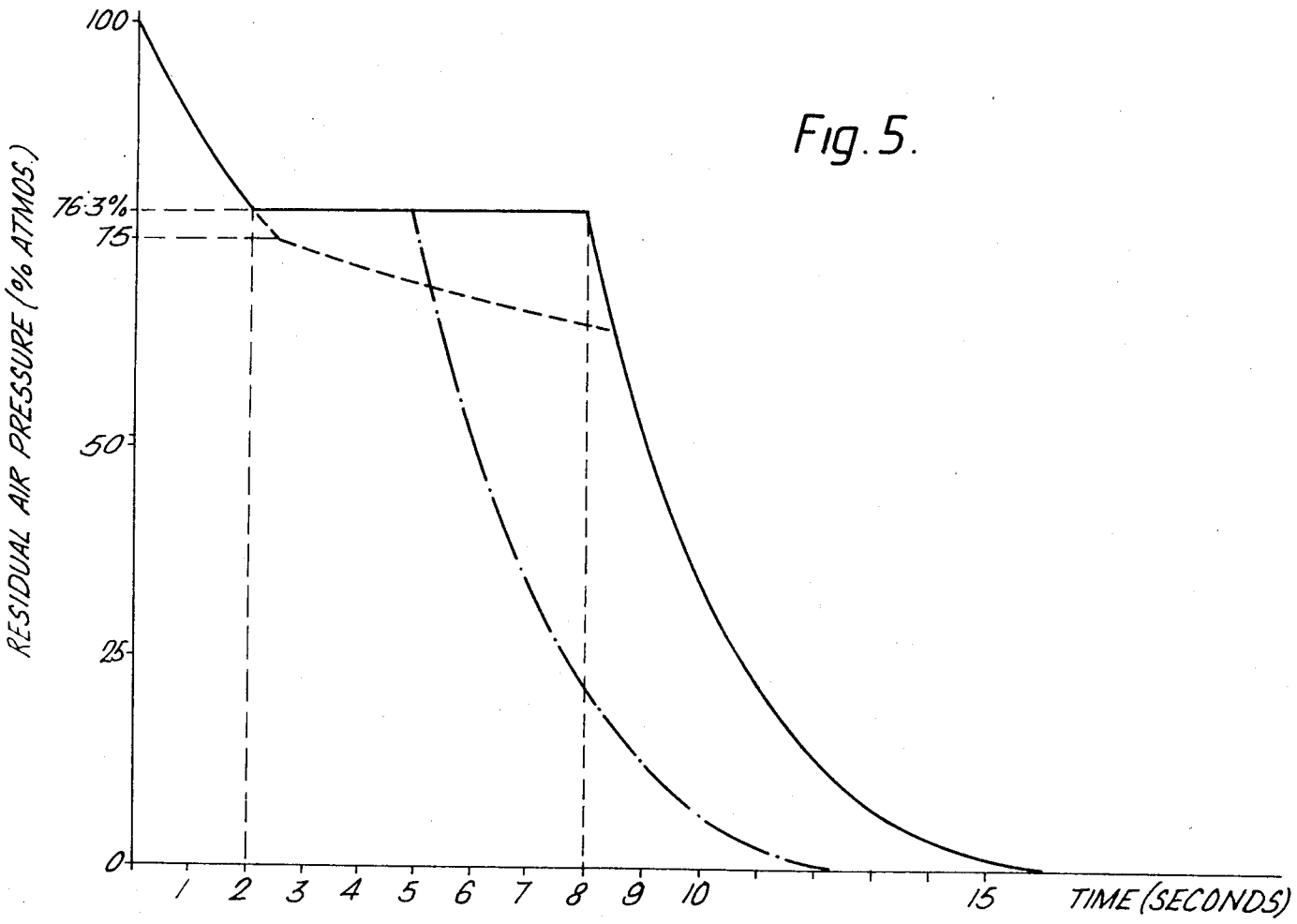
FIG. 5 is a graph plotting the reduction of residual air pressure in the shrink chamber as a function of time.

The solid line in FIG. 5 illustrates one form of the process in accordance with the present invention where the intermediate pressure is achieved after two seconds and that intermediate pressure of around 75% is retained for a further six seconds after which pressure drops to a residual value of around 6% after a total of fourteen seconds elapsed.

A first possible variation in the pressure excursion is illustrated by the chain-dotted lines in FIG. 5 and is one in which the same intermediate residual pressure value is retained but for only three seconds and then further evacuation is resumed and a residual pressure of around 6% is achieved after a total of ten seconds from the start of the evacuation.

A third possible process is illustrated by the dotted line where the initial evacuation of the chamber proceeds until the residual pressure is around 75% and the packaging film will have ballooned away from the product article 21. Evacuation then continues at a reduced rate for about six seconds so as to prolong ballooning by the continued extraction of air from outside the package as the gas from within the package escapes via the constricted bag neck, and finally the rate of evacuation is stepped up to reduce the chamber pressure to the required low value for sealing.

The precise choice of the intermediate pressure may, for example, be governed by the nature of the product article to be packed. Red meat having a particularly adhesive surface will have a tendency to resist separation of the bag material during ballooning, and consequently a lower "intermediate pressure" value may be required in order to ensure that adequate ballooning occurs before the hot air shrinking stage starts.

For any given product batch, the pressure within the chamber and the constricting effect of the clamping bars 23 and 24 on the bag neck should be such as to prompt the bag to undergo ballooning to an extent to ensure that heat transferred to the ballooned bag material by contact with the hot air flow is not immediately lost by conduction to the relatively cool product within the bag. Furthermore, where, as in the present embodiment, the application of heat relies upon circulation of hot air over the ballooned packaging film, the residual air pressure should not be reduced so far that the thermal capacity of the air remaining in the chamber 1 during the shrinking operation at that intermediate pressure is uneconomically low for effective heat transfer. The intermediate pressure is preferably in the range from 60% to 85% of residual air pressure, and is preferably at around 75% of residual air pressure.

As indicated above, the temperature of the product, the nature of the packaging film (e.g. the bag 4) and the volume of gas contained in the product, will also affect the ballooning pressure.

In general, the apparatus will be adjustable to allow for different values of the intermediate pressure to ensure that the bag will always have ballooned adequately by the time the shrinking heat is applied.

If desired, for example when packaging particularly soft articles such as cream cheeses, a "soft vacuum" pack may result in that the evacuation step is curtailed very soon after resumption of pressure drop below the "intermediate pressure" value.

As indicated above, the introduction of hot air may occur only during re-pressurisation of the chamber 1 or it may if desired be arranged for the hot air to be introduced into the chamber 1 while the cover 3 is descending and up to and including the instant at which the cover 3 closes onto the lower chamber portion 2 to seal at the rim 20, on the assumption that evacuation cannot begin until the chamber 1 is sealed. This will provide the best possible supply of hot air within the chamber 1 before evacuation.

It is envisaged that the operation of the fan 13 for the hot air introduction into the chamber 1 will be controlled in conjunction with the operation of the valve 14.

If desired, the package may include several product articles enclosed within one wrapper (for example in one bag 4).

Whether or not the heating is achieved by way of air circulation the application of heat may, if desired, begin as soon as the chamber is closed, or as soon as evacuation of the chamber starts.

Figure 6:
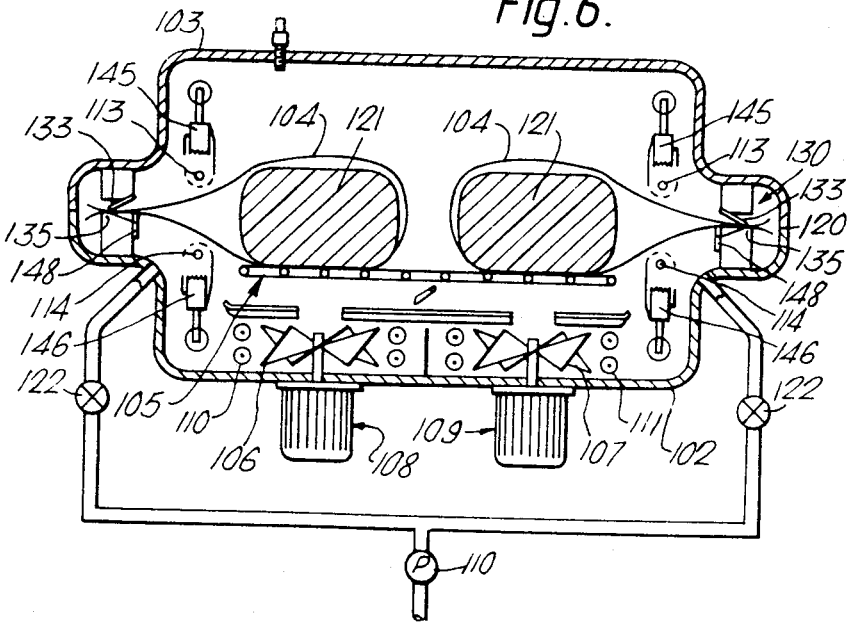
FIG. 6 is a longitudinal vertical section through a second embodiment of apparatus for forming a vacuum sealed package in accordance with the invention.
Figure 7:
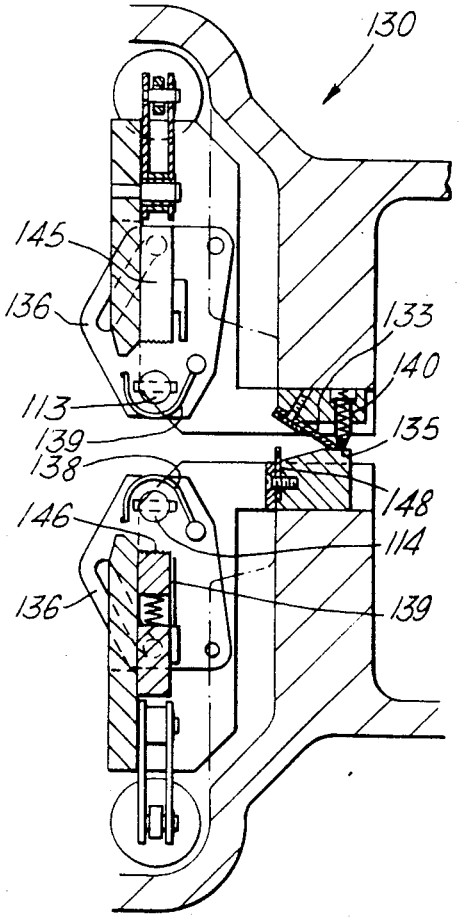
FIG. 7 is a detail showing the yieldable bag holding means of the apparatus of FIG. 6.

An alternative embodiment of the apparatus in accordance with the present invention is shown in FIGS. 6 and 7. In this case the chamber accommodates two separate products 121 in bags 104, placed back-to back along the chamber with the mouth of one bag at the right hand end of the chamber and the mouth of the other bag at the left hand end.

This embodiment of chamber has the lower chamber portion 102 closed by a cover portion 103 and has two fan rotors 106 ahd 107 driven by respcctive motors 108 and 109 and concentrically within circular heaters 110 and 111 to heat the air passing through the respective fan rotors 106 and 107. The chamber is evacuated by a pump 110 connected by way of separate control valves 122 to the respective ends of the lower chamber portion 102. A product support in the chamber lower portion comprises an array of rollers onto which the loaded bags can be placed.

At each end of the chamber, inwardly of the seal formed at its rim 120, is a yieldable bag-holding means 130 comprising an upper yieldable blade 133 and a lower counter member 135 between which the mouth region of the appropriate bag is held. An upper bag-clamping member 145 is combined with a source 113 of infra-red radiation, and a lower bag-clamping member 146 is associated with its respective infra-red radiation source 114.

A resistance wire 148 carried by the counter member 135 of the bag-holding means 130 is able to be energised with an electric pulse to rupture the ballooned bag neck when collapse of the bag neck is required.

FIG. 7 shows a detail of the yieldable bag-holding means 130 at the right hand end of the chamber.

The upper and lower infra-red radiation sources 113 and 114, respectively, are each carried by a respective pair of pivotable carrier plates of which one plate 136 of each set is visible in FIG. 7. The carrier plates, such as 136, are mounted at opposite ends of the respective upper and lower bag-clamping members 145 and 146.

The drive mechanism by which the upper and lower bag-clamping members 145 and 146 move towards one another and cause the carrier plates 136 to pivot to swing each infra-red radiation source 113 and 134 rightwardly away from the line of action of the converging clamping members 145 and 146 is described in detail in our British Patent Application No. 8,108,436 filed Mar. 18, 1981, the disclosure of which is incorporated herein by reference.

In the present application it is sufficient to state that as the upper and lower bag-clamping members 145 and 146 are driven together the infra-red radiation sources 113, 114 move aside, after having previously heated the ballooned bag neck region positioned between them (and kept free from contact with the radiation sources by virtue of respective wire screens 137 and 138). The upper and lower bag-clamping members 145, 146 then come into contact with one another whereupon the lower bag-clamping member 146 is depressed by virtue of its being resiliently carried by the carrier plate assembly, so that a trimming knife 139 is exposed and is capable of trimming excess plastic material from the sealed neck.

The fundamental difference between the embodiment of apparatus illustrated in FIGS. 6 and 7 and that illustrated in FIGS. 1 and 4 is that whereas in the apparatus in FIGS. 1 and 4 the bag neck is supported between undulating holding members shaped so as to allow limited extraction of air through the bag neck at all times, in the embodiment of FIGS. 6 and 7 the bag neck is yieldably clamped so as to achieve an earlier ballooning action in that no air escapes until the pressure difference between the interior and exterior of the bag 104 has reached a value at which the blade 113 yields to allow escape. This provides a controlled ballooning action on the bag neck. During this phase a plurality of spring-loaded pins 140 arranged along the bag mouth region helps to hold the bag against inadvertent displacement towards the centre of the chamber in such a way that the resilient holding action on the bag mouth is lost.

The sequence of operations with this embodiment is such that during the initial evacuation of air from the chamber the yieldable bag holding means 130 is effective to cause the bag to balloon up to a differential pressure value beyond which venting between the interior and exterior of the bag through the bag mouth is permitted by yielding of the blade 133. While the bag is thus ballooned, the fan rotors 106 and 107 and their respective heaters 110 and 111 operate to circulate hot air through the interior of the chamber and to effect thorough heat transfer to the film material making up the bags 104.

After sufficient time for adequate exposure of the ballooned bag material to the forced convection heat, the resistance wire 148 is energised and since it contacts the bag neck at periodically spaced points across the mouth of the bag it ruptures the bag mouth to allow the residual air previously held back in the bag by the resilient blade 133 to escape into the chamber interior.

Evacuation of the chamber then ensues until the vacuum level in the chamber reaches the desired level (either hard vacuum or soft vacuum, as the case may be) and the infra-red radiation sources 113, 114 are then energised to irradiate the bag neck with radiant heat to impart a higher localised temperature at the bag neck region, sufficient to cause that bag neck region to fuse to itself upon contact.

This contact is achieved by subsequent driving together of the upper and lower bag-clamping members 145 and 146 with the simultaneous cam-driven sideways movement of the radiation sources 113 and 114 and their respective wire screens 137 and 138 so that the bag material is thrust into contact with itself between the bag-clamping members 145 and 146 and becomes sealed. The repressurization of the chamber then presses together the film regions between the product 121 and the zone now held between the bag-clamping members 145 and 146, and achieves a tidying of the bag material at the seal.

The above-mentioned retraction of the lower bag-clamping member 146 to expose the trimming knife 139 ensures that when the bag neck is clamped between the members 145 and 146 the surface material, still held by the resiliently biased pins 140, is separated from the rest of the seal to leave a neat seal at the now closed bag neck.

As indicated in connection with the embodiment of FIGS. 1 and 4, it is not essential for the sealing action to be one of clamping the neck of the bag 104 between opposed clamping bars such as 145 and 146. Instead, some gathering action may be carried out on the heated bag neck thereby bringing the bag neck into a configuration in which it resembles a clipped bag neck, but the heating of the bag neck material due to the effect of the infra-red radiation will ensure that this gathered configuration is fused in the form of a tight package seal, even without the use of a clip.

Furthermore, the apparatus of FIGS. 6 and 7 can also be used with either a heat-shrinkable (i.e. oriented) film material or a self-welding film material.

In the embodiments described above, we have also referred to the process as evacuating air from within the chamber and air from within the package. It will of course be appreciated that some other gas may, if desired, be used. In any case some products may give off gas such as carbon dioxode to be extracted during the evacuation step, or the product may be flushed with an inert gas, even if air is the principal component gas within the chamber and/or bag.

Throughout the description of the preferred embodiments of process, the use of the air-circulating fans to enhance convective heat transfer has been described. However, it is of course possible for the heat to be applied to the packaging film by convection without the use of fan assisted circulation, or by some other mechamism, for example by heat radiation with or without some form of air circulation such as circulation-boosting by the fans. The process in accordance with the present invention relates to the discontinuity in the evacuation step and the precise mechanism by which heat is imparted to the packaging film may therefore be varied without departing from the scope of the invention as claimed.

I claim:

1. A process for forming a vacuum sealed package comprising a flexible film covering at least one product article, such process comprising the steps of subjecting the unsealed package to reducing pressure at a first rate of reduction to attain an intermediate pressure at which ballooning of said flexible film away from the surface of the said at least one product article occurs; reducing the rate of pressure reduction to a second and slower rate around the package when the said flexible film is in the ballooned condition so that evacuation of the package proceeds at a slower rate; heating the said ballooned flexible film while the rate of pressure reduction is so reduced; allowing the flexible film to collapse onto the surface of said at least one product article; sealing the package; and finally increasing the pressure around the sealed package.

* * * * *